US009614275B2

(12) United States Patent
Cicero

(10) Patent No.: US 9,614,275 B2
(45) Date of Patent: Apr. 4, 2017

(54) METHODS AND APPARATUS FOR WIDE BANDWIDTH ANTENNA WITH ENHANCED CONNECTION

(71) Applicant: Raytheon Company, Waltham, MA (US)

(72) Inventor: Patrick Cicero, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 34 days.

(21) Appl. No.: 14/847,503

(22) Filed: Sep. 8, 2015

(65) Prior Publication Data

US 2017/0069961 A1 Mar. 9, 2017

(51) Int. Cl.

| | |
|---|---|
| ***H01Q 13/10*** | (2006.01) |
| ***H01Q 1/38*** | (2006.01) |
| ***H01Q 9/04*** | (2006.01) |
| ***H01Q 13/02*** | (2006.01) |
| ***H01Q 1/28*** | (2006.01) |

(52) U.S. Cl.
CPC ..... *H01Q 1/38* (2013.01); *H01Q 1/28* (2013.01); *H01Q 9/0485* (2013.01); *H01Q 13/02* (2013.01); *H01Q 13/10* (2013.01)

(58) Field of Classification Search
CPC ..... H01Q 13/10; H01Q 13/02; H01Q 1/28
See application file for complete search history.

(56) References Cited

U.S. PATENT DOCUMENTS

| | | | | |
|---|---|---|---|---|
| 2,822,542 | A | 2/1958 | Butterfield et al. | |
| 4,803,495 | A * | 2/1989 | Monser | H01Q 1/523 343/725 |
| 5,126,751 | A | 6/1992 | Wada et al. | |
| 6,278,410 | B1 | 8/2001 | Soliman et al. | |
| 7,589,686 | B2 | 9/2009 | Balzovsky et al. | |
| 7,649,501 | B2 | 1/2010 | Wong et al. | |
| 8,736,502 | B1 * | 5/2014 | Langfield | H01Q 19/06 343/753 |
| 2014/0266950 | A1 | 9/2014 | Cicero | |

OTHER PUBLICATIONS

PCT Search Report and Written Opinion of the ISA for PCT/US2016/026099 dated Nov. 17, 2016; 10 Pages.

* cited by examiner

*Primary Examiner* — Hoang V Nguyen
(74) *Attorney, Agent, or Firm* — Daly, Crowley, Mofford & Durkee, LLP

(57) ABSTRACT

Methods and apparatus for a directive, instantaneous wide bandwidth antenna including a ground plane having a recess with a tapered region accessible by an electromagnetic field via a radiating aperture at a forward end of the recess. The dielectric feed can have a tapered portion proximate the tapered region to guide the electromagnetic field into the recess through the radiating aperture and influence pattern directivity. The antenna can further include a conductive plating disposed at least partially about the dielectric feed in a wedge configuration to influence pattern beam width. The dielectric feed can include a conductive portion on a bottom of the wedge coupled to the conductive plating and to a grooved trace.

20 Claims, 11 Drawing Sheets

METHODS AND APPARATUS FOR WIDE BANDWIDTH ANTENNA WITH ENHANCED CONNECTION

BACKGROUND

As is known in the art, there are a wide variety of antennas that can be used for different applications. It is desirable to increase antenna performance, such as by achieving higher gains and wider frequency bandwidths, as well as to enhance fabrication of antennas.

SUMMARY

In one aspect of the invention, an antenna comprises: a ground plane having a recess with a tapered region accessible by an electromagnetic field via a radiating aperture at a forward end of the recess; an elongate dielectric feed disposed in the recess, the dielectric feed having a tapered portion proximate the tapered region to guide the electromagnetic field into the recess through the radiating aperture and influence pattern directivity; a conductive plating disposed at least partially about the dielectric feed in a wedge configuration to influence pattern beam width, and having a taper to facilitate propagation of the electromagnetic field over a range of frequencies, wherein the conductive plating is disposed toward a rearward end of the recess relative to the radiating aperture; and a conductive plating portion on a bottom of the wedge configuration coupled to the conductive plating and extending to a grooved trace to receive a conductor of a cable.

The antenna can further include one or more of the following features: the grooved trace is configured to receive the center conductor of a coaxial cable, the grooved trace is soldered to the conductor, the soldered connection of the grooved trace and the conductor is the only solder connection to antenna, the conductive plating on the dielectric feed does not overlap with the grooved trace, the wedge configuration comprises a wedge angle of between about 45 degrees and about 60 degrees, the recess comprises a depth of between about 2.5 mm and about 25 mm, the taper of the conductive plating comprises a taper angle of between about 9 degrees and about 10 degrees, a length of the dielectric feed in the radiating aperture is between about 13 mm and about 102 mm, a conductive cover disposed over a portion of the recess and forming the radiating aperture, an electromagnetic field absorber disposed in the recess, the absorber comprises a magnetic material disposed toward the rearward end of the recess relative to the elongate dielectric feed to minimize electromagnetic scattering off a back wall of the recess, the absorber is tapered narrower toward the forward end to influence broadband termination, the magnetic material comprises a lossy magnetic load material, the absorber comprises a non-magnetic material disposed to a side of the elongate dielectric feed to minimize interference from electromagnetic scattering off a side wall of the recess while allowing forward or backward directed electromagnetic energy in the recess, the absorber comprises a tapered portion disposed proximate the tapered region of the recess in the radiating aperture, the absorber is disposed lateral of the conductive plating, the non-magnetic material comprises a lossy foam material, and/or the absorber is spaced at a lateral distance from the dielectric feed to facilitate electromagnetic radiation therebetween.

In another aspect of the invention a method comprises employing a ground plane having a recess with a tapered region accessible by an electromagnetic field via a radiating aperture at a forward end of the recess; employing an elongate dielectric feed disposed in the recess, the dielectric feed having a tapered portion proximate the tapered region to guide the electromagnetic field into the recess through the radiating aperture and influence pattern directivity; employing a conductive plating disposed at least partially about the dielectric feed in a wedge configuration to influence pattern beam width, and having a taper to facilitate propagation of the electromagnetic field over a range of frequencies, wherein the conductive plating is disposed toward a rearward end of the recess relative to the radiating aperture; and employing a conductive plating portion on a bottom of the wedge configuration coupled to the conductive plating and extending to a grooved trace to receive a conductor of a cable.

The method can further include one or more of the following features: the grooved trace is configured to receive the center conductor of a coaxial cable, the grooved trace is soldered to the conductor, the soldered connection of the grooved trace and the conductor is the only solder connection to antenna, the conductive plating on the dielectric feed does not overlap with the grooved trace, the wedge configuration comprises a wedge angle of between about 45 degrees and about 60 degrees, the recess comprises a depth of between about 2.5 mm and about 25 mm, the taper of the conductive plating comprises a taper angle of between about 9 degrees and about 10 degrees, a length of the dielectric feed in the radiating aperture is between about 13 mm and about 102 mm, a conductive cover disposed over a portion of the recess and forming the radiating aperture, an electromagnetic field absorber disposed in the recess, the absorber comprises a magnetic material disposed toward the rearward end of the recess relative to the elongate dielectric feed to minimize electromagnetic scattering off a back wall of the recess, the absorber is tapered narrower toward the forward end to influence broadband termination, the magnetic material comprises a lossy magnetic load material, the absorber comprises a non-magnetic material disposed to a side of the elongate dielectric feed to minimize interference from electromagnetic scattering off a side wall of the recess while allowing forward or backward directed electromagnetic energy in the recess, the absorber comprises a tapered portion disposed proximate the tapered region of the recess in the radiating aperture, the absorber is disposed lateral of the conductive plating, the non-magnetic material comprises a lossy foam material, and/or the absorber is spaced at a lateral distance from the dielectric feed to facilitate electromagnetic radiation therebetween.

BRIEF DESCRIPTION OF THE DRAWINGS

The foregoing features of this invention, as well as the invention itself, may be more fully understood from the following description of the drawings in which.

DETAILED DESCRIPTION

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although prior antennas have been serviceable for many applications, such as missiles or UAVs, multiple antennas have sometimes been utilized in order to provide the desired bandwidth. In addition, use with missiles or UAVs also places size restrictions on antennas. For example, antenna depth and volume may be restricted to minimize the antenna's impact on aerodynamics, as well as to permit the antenna to fit within internal space constraints of the missile or UAV. In this case, using multiple antennas only compounds the size problem.

Accordingly, a directive, instantaneous wide bandwidth antenna is disclosed that increases instantaneous frequency bandwidth over previous antennas and can do so without requiring multiple antennas. In one aspect, the antennas of the present disclosure can be conformal to fit within a small size envelope, particularly at or near an outer surface of a missile or UAV. The directive, instantaneous wide bandwidth antenna can include a ground plane having a recess with a tapered region accessible by an electromagnetic field via a radiating aperture at a forward end of the recess. The antenna can also include an elongate dielectric feed disposed in the recess. The dielectric feed can have a tapered portion proximate the tapered region to guide the electromagnetic field into the recess through the radiating aperture and influence pattern directivity. The antenna can further include conductive plating disposed at least partially about the dielectric feed in a wedge configuration to influence pattern beam width. The conductive plating can have a taper to facilitate propagation of the electromagnetic field over a range of frequencies. The conductive plating can be disposed toward a rearward end of the recess relative to the radiating aperture.

Figure 1A:
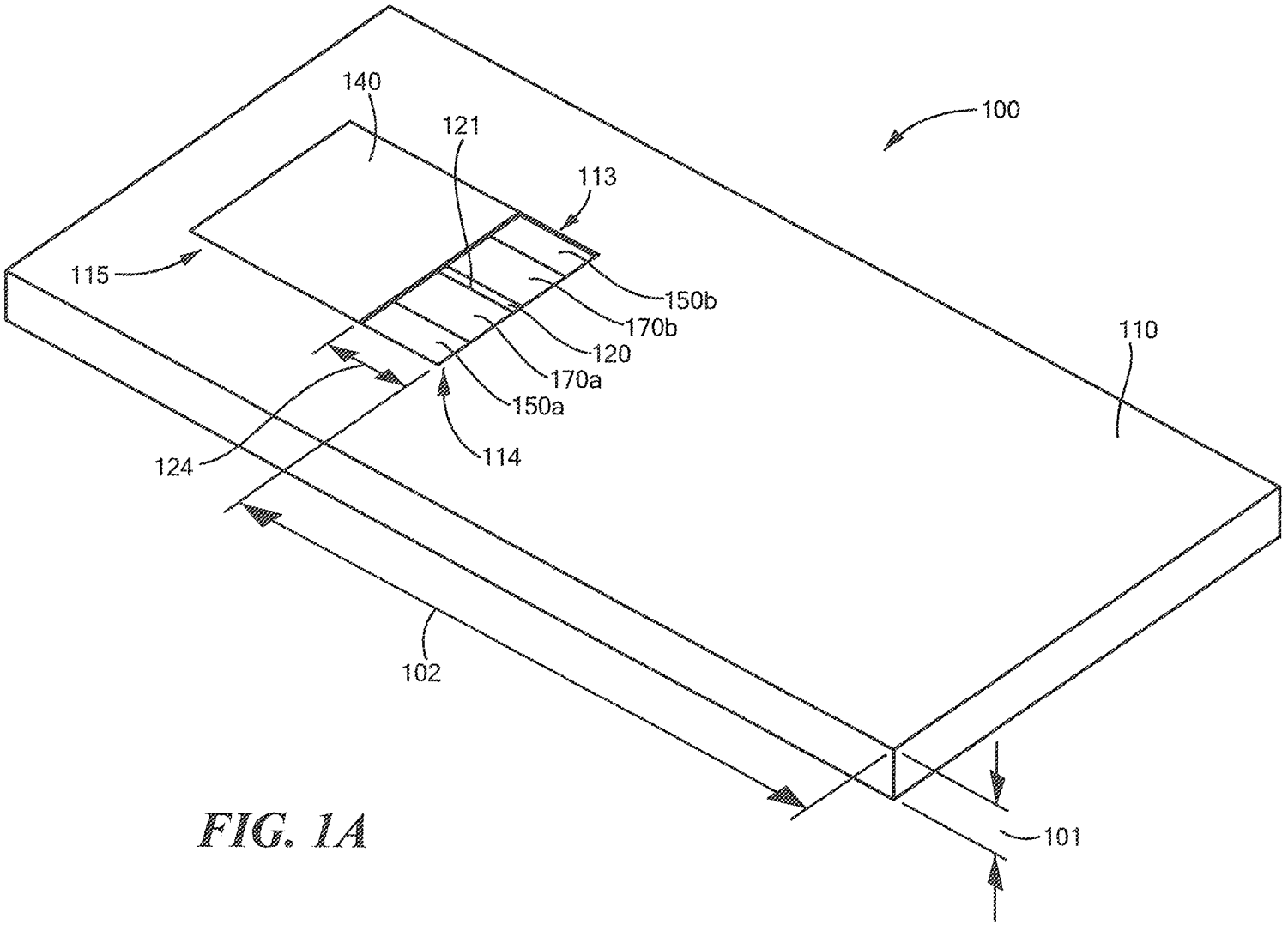
FIG. 1A is an example illustration of a directive, instantaneous wide bandwidth antenna in accordance with an embodiment of the present invention.
Figure 1B:
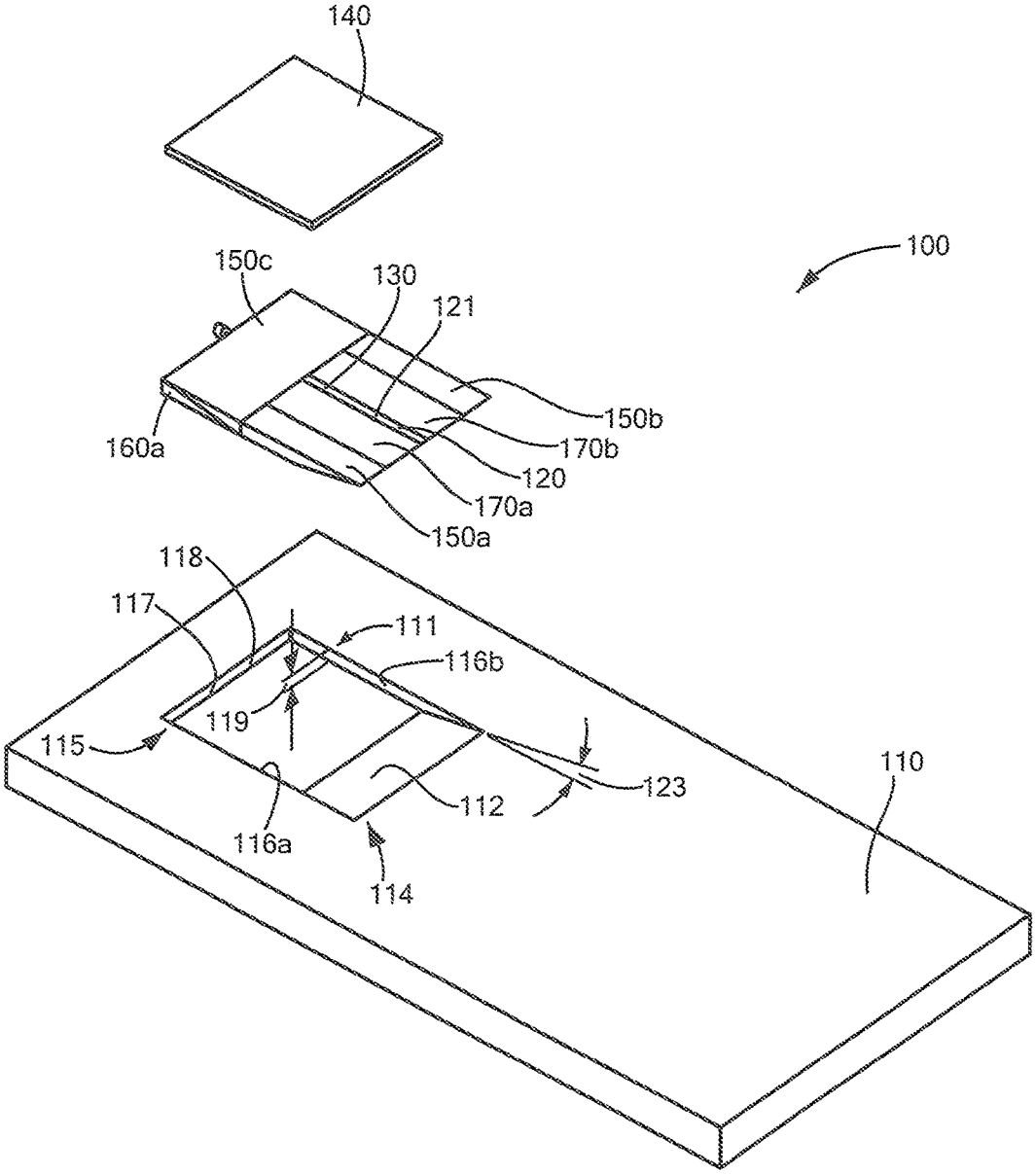
FIG. 1B is an exploded view of the directive, instantaneous wide bandwidth antenna of FIG. 1A.

One embodiment of a directive, instantaneous wide bandwidth antenna 100 is illustrated in FIGS. 1A and 1B. The antenna 100 can comprise a ground plane 110 having a recess 111 at a depth 119 with a tapered region 112 accessible by an electromagnetic field via a radiating aperture 113 at a forward end 114 of the recess 111. The aperture 113 can have a length 124 and the tapered region 112 can have a taper angle 123. The antenna 100 can also include an elongate dielectric feed 120 disposed in the recess 111. The elongate dielectric feed 120 can have a tapered portion 121 proximate the tapered region 112 of the recess 111 to guide the electromagnetic field into the recess 111 through the radiating aperture 113 and influence pattern directivity. The elongate dielectric feed 120 can be constructed of polytetrafluoroethylene (PTFE), ceramic, DUROID®, or any other low loss dielectric material having a relative dielectric constant of between about 2 and about 4.5. The antenna 100 can further include conductive plating 130 disposed at least partially about the dielectric feed 120 in a wedge configuration to influence pattern beam width. The conductive plating 130 can be constructed of copper, gold, silver, or any other suitable electrically conductive metallic material. As discussed in more detail hereinafter, the conductive plating 130 can also have a taper to facilitate propagation of the electromagnetic field over a range of frequencies. As shown in the figures, the conductive plating 130 can be disposed toward a rearward end 115 of the recess 111 relative to the radiating aperture 113. In one aspect, the conductive plating 130 can be covered by a conductive cover 140 disposed over a portion of the recess 111 and forming the radiating aperture 113. In another aspect, the tapered portion 121 of the dielectric feed 120 can be exposed through the radiating slot 113. The conductive cover 140 can be permanently affixed relative to the recess 111 or removably attached. The conductive cover 140 can be constructed of copper, gold, silver, or any other suitable electrically conductive metallic material.

The recess depth 119 can influence which frequencies the antenna 100 can receive. For example, a deeper recess depth 119 can facilitate the reception of lower frequencies and a shallower recess depth can facilitate the reception of higher frequencies. Altering the recess depth 119 can therefore result in a frequency shift. Indeed, in general, scaling the antenna 100 to have larger dimensions will facilitate the reception of lower frequencies and scaling the antenna 100 to have smaller dimensions will facilitate the reception of higher frequencies. In one aspect, the recess depth can be between about 2.5 mm and about 25 mm. In some embodiments, the taper angle 123 can be based upon the recess depth 119 and the length 124 of the aperture 113. Thus, in a particular aspect, the taper angle 123 can be given by the arctangent of the recess depth 119 divided by the aperture length 124.

In some embodiments, the antenna 100 can be conformal in that the antenna can have a low profile to fit, for example, at or near a surface of a missile or rocket. The conformal nature of such embodiments can accommodate missiles or rockets having interiors tightly packed with electronics, guidance, sensors, warheads, or other missile components by minimizing intrusion into precious interior space without protruding from the missile or rocket exteriors. The overall size dimensions of the antenna 100 can generally reflect the size dimensions of the ground plane 110, which can be designed as a structural support for the various antenna 100 components discussed herein. As such, the ground plane dimensions can be influenced by the size of the antenna components, some of which are discussed hereinafter. For example, ground plane thickness 101 can be slightly more than the recess depth 119 sufficient to provide structural support. The dielectric feed 120 and conductive plating 130 can guide electromagnetic fields to radiating aperture 113. As discussed further hereinafter, the angle of the wedge configuration, coupled with the relative dielectric constant of the dielectric feed material, can provide a highly directive antenna (very high front to back gain ratio). This also allows the antenna 100 to use a very shallow cavity depth, which can be important for most conformal antennas used in missile applications. For example, a small thickness 101 can be useful for small diameter missile applications. Antenna 100 dimensions can be optimized to allow the antenna 100 to perform better at any subset of frequencies from VHF to K band. In one aspect, the size of the antenna components can yield a thickness 101 of the antenna 100 of between about 3 mm and about 35 mm. For example, a thickness 101 of about 6.3 mm can result from an antenna optimized for X band frequencies.

As shown herein, the antenna 100 can provide very wide bandwidth, high directivity, and linear polarization in a shallow conformal package. In some embodiments, the antenna 100 can be implemented as a high gain conformal antenna that can be used in a very shallow cavity on a wide range of missile and UAV airframes. The extremely wide broadband frequency of operation can minimize fabrication tolerance issues and allow a single antenna 100 to be used in place of multiple narrow band antennas, thus reducing cost and volume required on tightly packaged missile or UAV systems. In one aspect, the antenna 100 can be used as a single antenna element or in an array of elements forming a larger antenna.

Performance of the antenna 100 is largely ground plane independent. Thus, the ground plane 110 can extend any suitable distance from the radiating aperture 113 of the recess 110 although, in general, a greater forward length 102 can lead to better antenna performance. In addition, the antenna 100 can be frequency scalable in that the antenna can be operable with a desired frequency range simply by physically scaling the antenna. For example, an antenna can be operable with higher frequencies by reducing the size of the antenna. In one aspect, the antenna 100 can be optimized for any subset of an entire frequency band or scaled to achieve higher or lower frequencies. In some embodiments, the antenna 100 can also exhibit monotonically increasing gain with frequency and a very stable gain curve above 2 GHz.

Figure 2A:
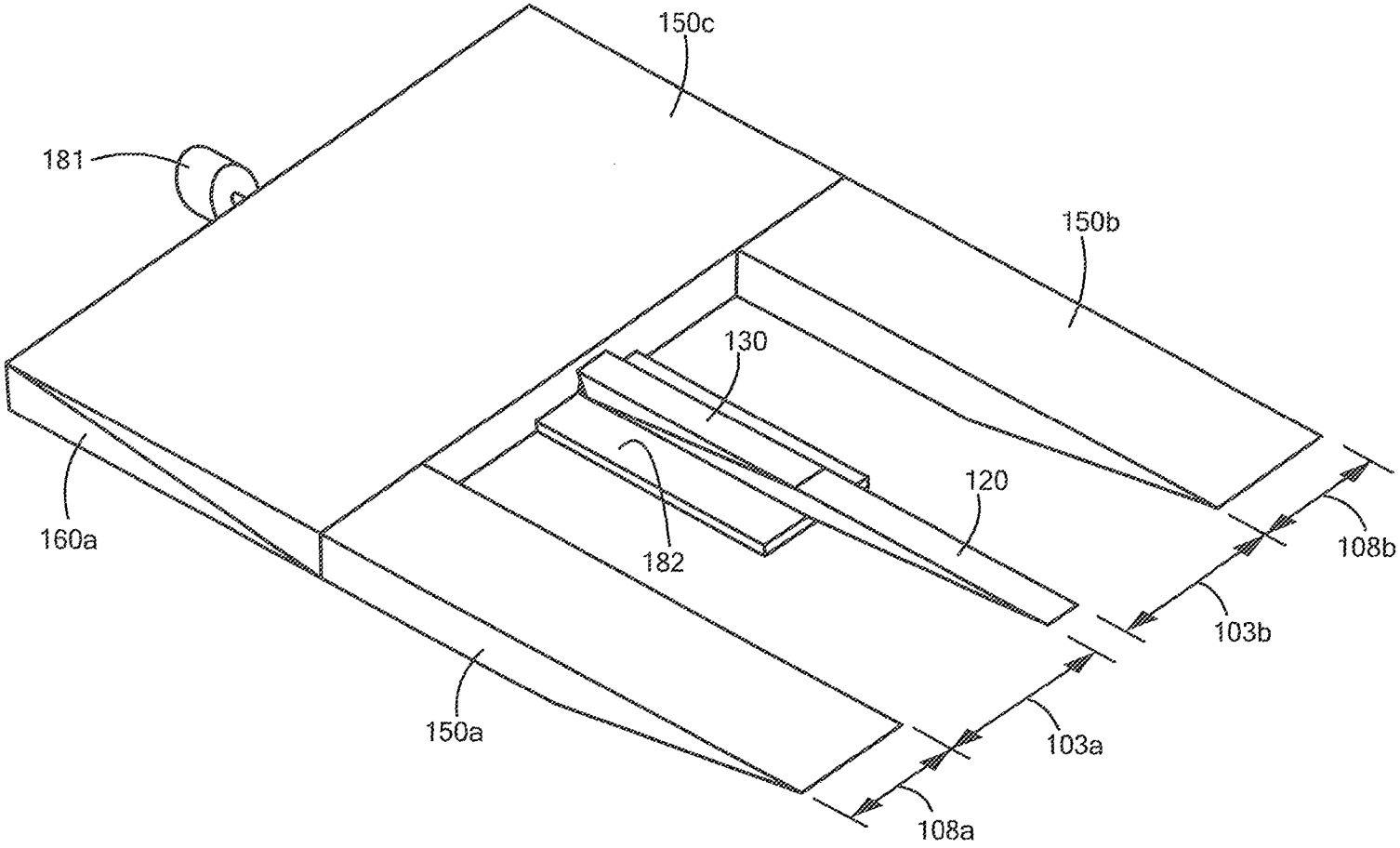
FIG. 2A is a detailed view of internal components of the directive, instantaneous wide bandwidth antenna of FIG. 1A.
Figure 2B:
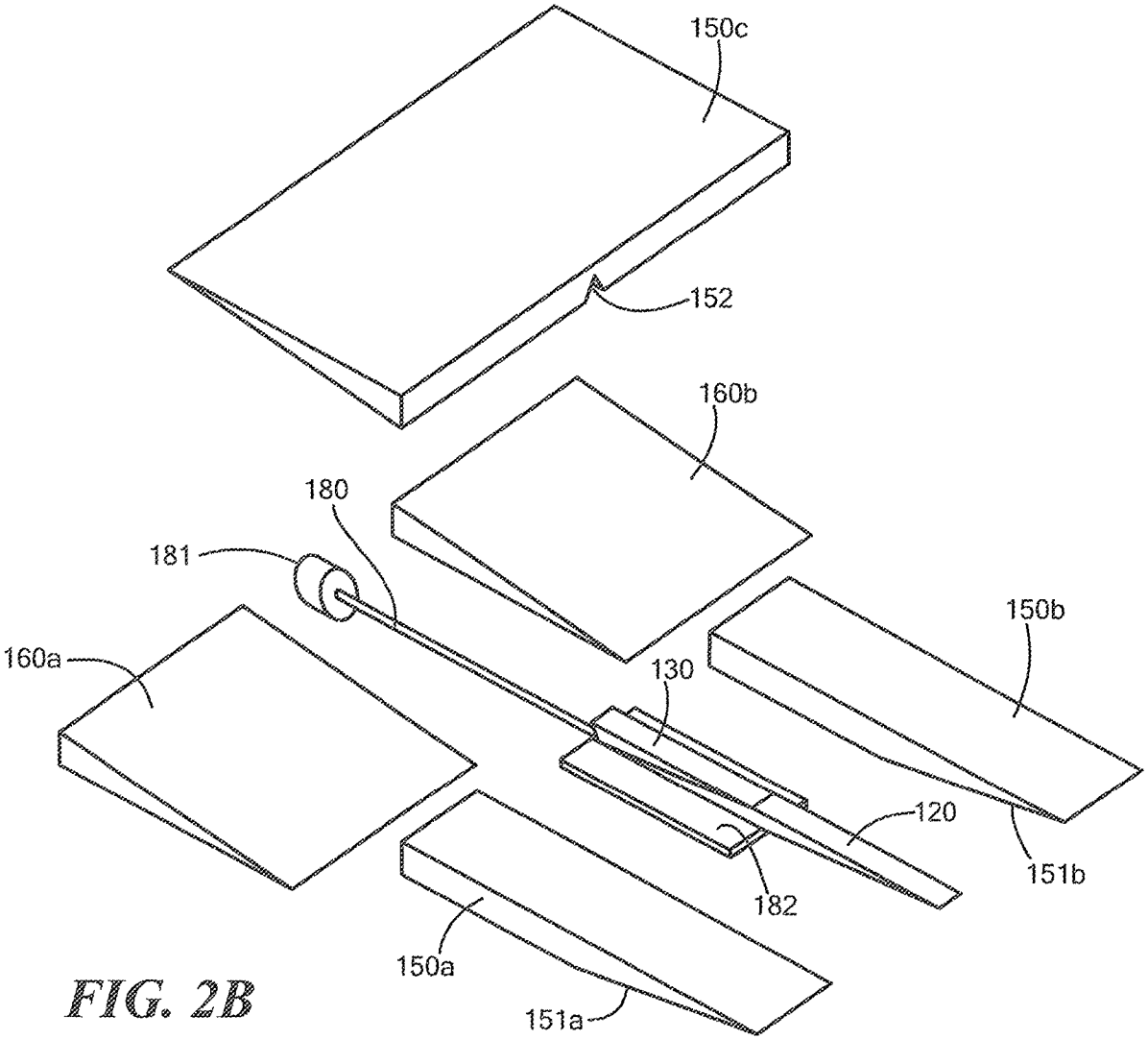
FIG. 2B is an exploded view of the antenna internal components of FIG. 2A.

With reference to FIGS. 2A and 2B, and continued reference to FIGS. 1A and 1B, the antenna 100 can include an electromagnetic field absorber disposed in the recess 111. For example, absorber 150*a*, 150*b*, 150*c* can comprise a non-magnetic material, such as a carbon loaded foam or other lossy foam material, disposed to a side of the elongate dielectric feed 120 to minimize interference from electromagnetic scattering off a side wall 116*a*, 116*b* of the recess 111 while allowing forward or backward directed electromagnetic energy in the recess 111. In one aspect, the absorber can have a tapered portion 151*a*, 151*b* disposed proximate the tapered region 112 of the recess 111 in the radiating aperture 113. In another aspect, the absorber 150*a*, 150*b*, 150*c* can include portions disposed lateral to the conductive plating 130, for example, by having portions disposed proximate the side walls 116*a*, 116*b* of the recess 111. In a particular aspect, the absorber 150*a*, 150*b* can be spaced at a lateral distance 103*a*, 103*b* from the dielectric feed 120 to facilitate electromagnetic radiation therebetween. In one aspect, the lateral distance 103*a*, 103*b* can be selected to allow radiation to occur without absorbing power.

As shown in FIGS. 1A and 1B, a spacer 170*a*, 170*b* can be disposed between the absorber 150*a*, 150*b*, respectively, and the dielectric feed 120 to maintain the lateral distance 103*a*, 103*b* between the absorber 150*a*, 150*b* and the dielectric feed 120. The spacer 170*a*, 170*b* has been omitted from FIGS. 2A and 2B to reveal other characteristics and elements of the antenna 100. The spacer 170*a*, 170*b* can be constructed of a structural foam, such as ROHACELL®, polymethacrylimide, or any other low density rigid foam or other suitable material. In one aspect, the spacer can be constructed of a material having electrical properties that are similar to air.

As shown in the figures, the absorber 150*a*, 150*b*, 150*c* and the spacer 170*a*, 170*b* can be used to substantially fill space in the recess 111 between the side walls 116*a*, 116*b*. This can be beneficial to stabilize or prevent relative movement of antenna components during use, for example, on a missile or rocket. However, it should be recognized that the spacer 170*a*, 170*b* can be omitted or the absorber 150*a*, 150*b*, 150*c* can be designed to minimize material, thus resulting in empty space within the recess 111. In one aspect, regardless of whether a spacer 170*a*, 172*b* is included, a width 108*a*, 108*b* of the absorber 150*a*, 150*b* can be determined by the degree to which reflections from the side walls 116*a*, 116*b* are to be prevented or blocked.

With further reference to FIGS. 1A-2B, the antenna 100 can also include an absorber 160*a*, 160*b* comprising a magnetic material, such as ECCOSORB®, a radar absorbing material, or any other lossy magnetic load material, disposed toward the rearward end 115 of the recess 111 relative to the elongate dielectric feed 120 to minimize electromagnetic scattering off a back wall 117 of the recess 111. The absorber 160*a*, 160*b* can be tapered narrower toward the forward end 114 to influence broadband termination. A longer taper can provide more effective broadband termination, which can improve broadband performance of the antenna 100.

With particular reference to the exploded view in FIG. 2B, the absorber 160*a*, 160*b* is shown illustrated as two separate absorbers to accommodate an electrical connection 180 coupling a connector 181 to the conductive plating 130. It should be recognized that the absorber 160*a*, 160*b* can comprise a single component or any number of individual components, as desired. For example, a single absorber 160*a*, 160*b* can include a groove or channel similar to groove 152 of absorber 150*c* to accommodate the electrical connection 180. The electrical connection 180 can comprise any suitable electromagnetic transmission line, such as a cable (e.g., coaxial cable), a stripline, a microstrip, a wire, or any other suitable electrical connection coupling the conductive plating 130 to the connector 181. As shown in FIG. 1B, the electrical connection 180 can extend through a hole 118 or other suitable feature in the ground plane in order to provide external access to the connector 181. In one aspect, the connector 181 can be located below or behind an antenna cavity of a missile or UAV, which can allow more freedom in integrating the antenna 100 into thin-walled missile or UAV airframes. For example, the antenna 100 can be fed from a bottom side or rear of the ground plane 110, which can provide an antenna 100 that is highly adaptable to different airframe configurations. Referring again to FIG. 2B, the conductive plating 130 can be electrically coupled to the electrical connection 180 via a circuit board 182. In one aspect, the circuit board 182 can provide stability and support for the conductive plating 130 and the dielectric feed 120.

Figure 3A:
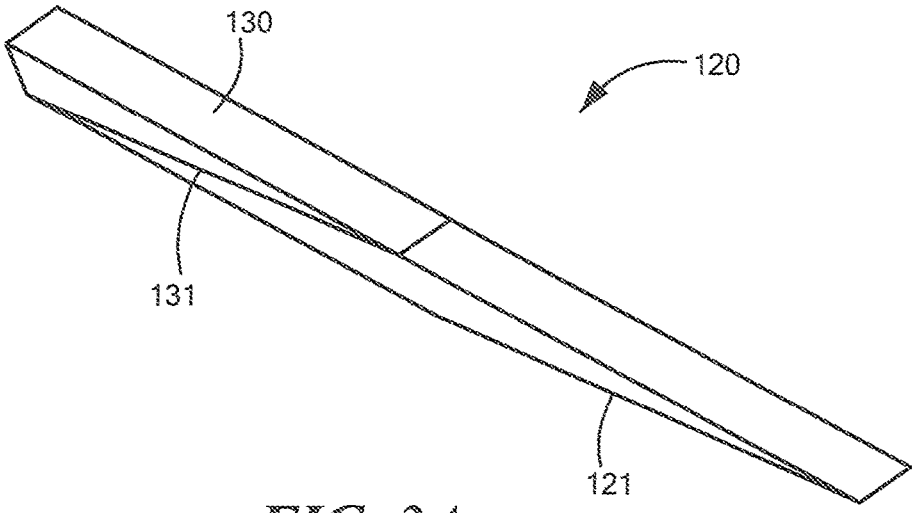
FIG. 3A is a perspective view of an elongate dielectric feed and conductive plating of the directive, instantaneous wide bandwidth antenna of FIG. 1A.
Figure 3B:
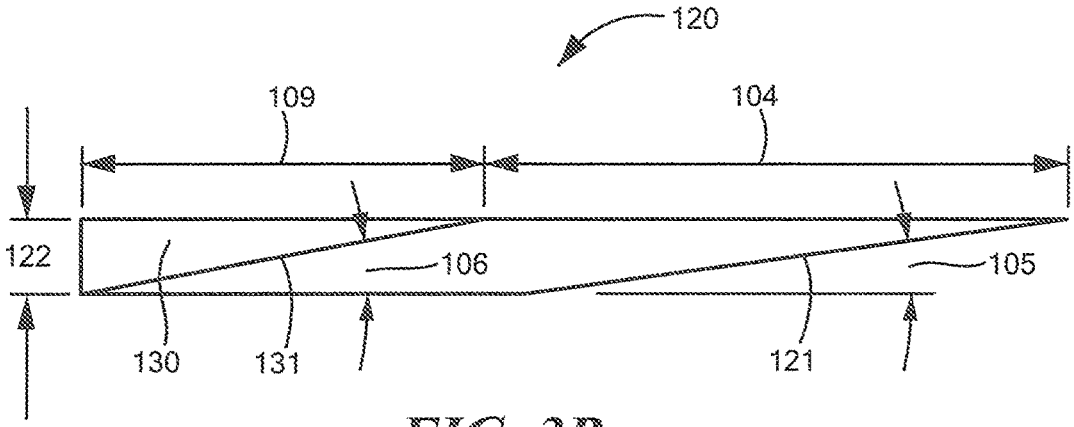
FIG. 3B is a side view of the elongate dielectric feed and conductive plating of FIG. 3A.
Figure 3C:
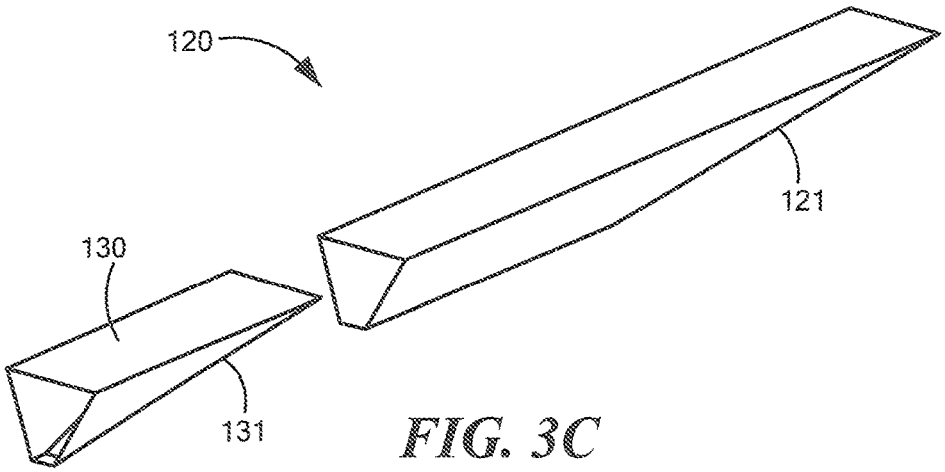
FIG. 3C is an exploded view of the elongate dielectric feed and conductive plating of FIG. 3A.

FIGS. 3A-3C illustrate several isolated views of the elongate dielectric feed 120 and the conductive plating 130. With further reference to FIGS. 1A-2B, a length 104 of the dielectric feed 120 in the radiating aperture 113 can correspond to the length 124 of the aperture 113 (see FIG. 1A) and influence pattern directivity of the antenna 100, such that increasing length 104 can produce a more directive antenna pattern. For example, the antenna 100 can have a highly directive focused beam (front to back ratio ~25 dB at 18 GHz). In one aspect, the length 104 can be between about 13 mm and about 102 mm. Although the length 104 primarily controls pattern directivity, the length 104 can also provide additional control of beam width. The length 104 is shown as extending to the conductive plating 130 because, in general, the conductive plating does not extend into the radiating aperture 113 and therefore represents an edge of the aperture 113, such as defined by the conductive cover 140. In one aspect, the conductive plating 130 can extend to the rearward edge of the aperture 113. However, the conductive plating 130 can terminate at any point short of the aperture 113. In one aspect, the elongate dielectric feed 120 can have a height 122 that corresponds to the depth 119 of the recess 111 (see FIG. 1B).

The tapered portion 121 can guide electromagnetic fields into the recess 111 through the radiating aperture 113. In one aspect, the tapered portion 121 can have a taper angle 105 that corresponds to the taper angle 123 of the tapered region 112 of the recess 111 (see FIG. 1B). The conductive plating 130 can also include a taper 131 to facilitate propagation of the electromagnetic field over a range of frequencies, thus contributing to the broadband attributes of the antenna 100. For example, the antenna 100 can have a very wide instantaneous frequency bandwidth (~25:1 bandwidth (or even between 15:1 and 25:1) based on a voltage standing wave ratio (VSWR) of 3:1), which is a much wider frequency bandwidth than available from typical missile antennas. In some embodiments, the very wide instantaneous frequency bandwidth can be greater than 15:1 bandwidth. In other embodiments the very wide instantaneous frequency bandwidth can be between 15:1 and 25:1 bandwidth. In still other embodiments, the instantaneous frequency bandwidth can be less than 18:1 bandwidth.

It is further contemplated in still other embodiments that the antenna can be configured to operate over narrower instantaneous frequency bandwidths. For example, the various components or elements of the antenna can be configured differently, such that the antenna can operate over narrower instantaneous frequency bandwidths. In some embodiments this may be 2:1 bandwidth. In other embodiments this may be from 2:1 up to the wider frequency bandwidths as discussed above.

In one aspect, a taper angle 106 of the conductive plating can be between about 9 degrees and about 10 degrees. Typically, the tapers discussed herein are linear, although other taper shapes, such as non-linear, are contemplated. In some aspects, the taper angle 106 of the taper 131 and a length 109 of the conductive plating 130 can influence pattern directivity of the antenna 100. These dimensions can be balanced or optimized with the length 104 of the dielectric feed 120 in the radiating aperture 113 to provide an antenna 100 with desired pattern directivity, pattern beam width, and frequency bandwidth. The antenna 100 as shown and described herein can therefore provide a wide instantaneous frequency bandwidth, such that the wide frequency bandwidth is always available and no tuning is needed in order to achieve the wide bandwidth.

It should be recognized that aside from the taper angle 105, the dielectric feed can be of any suitable shape or dimension. In some embodiments, a shape or dimension of the dielectric feed can be based on a shape or dimension of the conductive plating, such as wedge angle 107 shown in FIG. 4. In addition, although the conductive plating 130 is shown in the figures as being disposed external to the dielectric feed 120, it should be recognized that the conductive plating 130 can be disposed, in whole or in part, inside the dielectric feed 120. Thus, a shape of a dielectric feed in accordance with the present disclosure can vary widely from the figures discussed herein.

Figure 4:
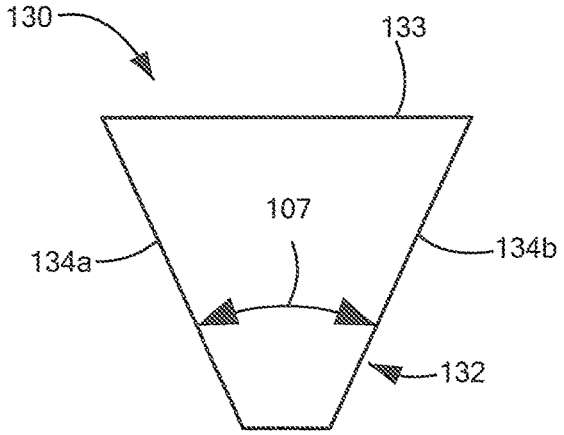
FIG. 4 is an end view of the conductive plating of FIG. 3A.
Figure 5A:
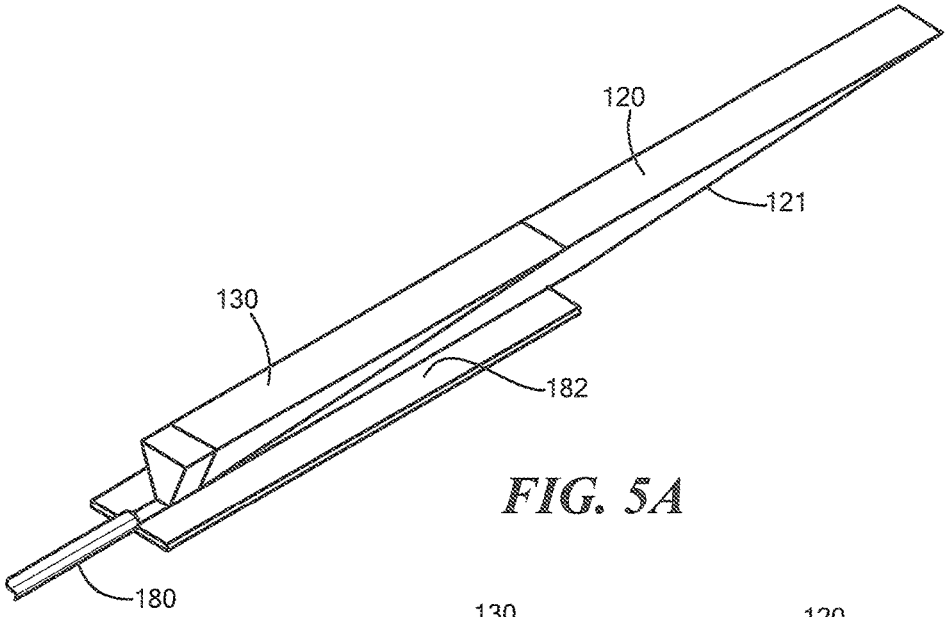
FIGS. 5A-D are schematic representations of an illustrative multi-point antenna connector configuration.
Figure 5D:
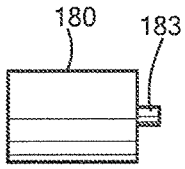
Figure 5B:
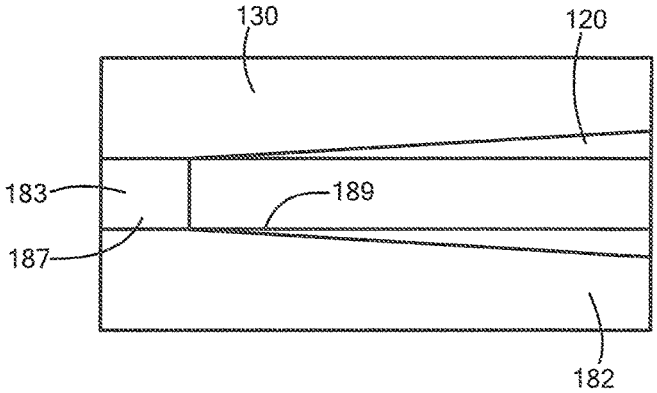
Figure 5C:
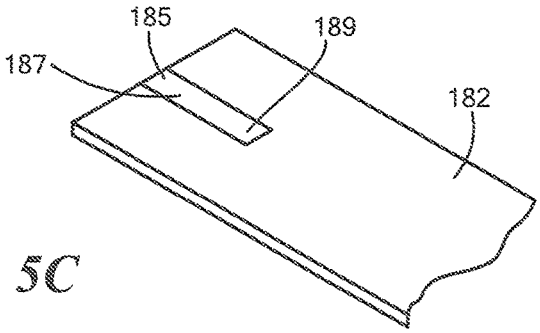

FIG. 4 illustrates an end view of the conductive plating 130. The conductive plating 130 can have a wedge configuration 132 with a wedge angle 107 influencing pattern beam width, such that decreasing the wedge angle 107 produces a narrower beam width. For example, the wedge angle 107 can provide control of the antenna pattern main lobe beam width. In one aspect, the wedge angle 107 can be between about 45 degrees and about 60 degrees. The conductive plating 130 disposed about a portion of the dielectric feed 120 can provide unique control over antenna beam width above C band, which exceeds the control over pattern beam width available from typical missile of UAV antennas. The conductive plating 130 can be of any suitable thickness. In one aspect, a plating thickness can be between about 0.02 mm and about 0.25 mm. The conductive plating 130 and the conductive cover 140 can be configured to be in electrical contact with one another. For example, a top portion 133 of the conductive plating 130 can be configured to electrically interface with a bottom of the conductive cover 140. In some embodiments, the conductive plating 130 can be configured without a top portion 133. In this case, sides 134*a*, 134*b* can be configured to electrically interface with a bottom of the conductive cover 140. In general, sides 134*a*, 134*b* can be substantially planar, although variations from a planar condition can exist with decreased antenna performance. In addition, although generically referred to herein as "plating," the conductive plating 130 can be constructed or manufactured in any suitable manner using any suitable technique.

In accordance with one embodiment of the present invention, a method for facilitating use of a directive, instantaneous wide bandwidth antenna is disclosed. The method can comprise providing an antenna including a ground plane having a recess with a tapered region accessible by an electromagnetic field via a radiating aperture at a forward end of the recess, an elongate dielectric feed disposed in the recess, the dielectric feed having a tapered portion proximate the tapered region to guide the electromagnetic field into the recess through the radiating aperture and influence pattern directivity, and a conductive plating disposed at least partially about the dielectric feed in a wedge configuration to influence pattern beam width, and having a taper to facilitate propagation of the electromagnetic field over a range of frequencies, wherein the conductive plating is disposed toward a rearward end of the recess relative to the radiating aperture. Additionally, the method can comprise facilitating conformance of the antenna in an antenna cavity of a vehicle. In one aspect, a thickness of the antenna is thicker than a recess depth (e.g., see recess depth 119 of FIGS. 1A and 1B), and can be between about 3 mm and about 35 mm. It is noted that no specific order is required in this method, though generally in one embodiment, these method steps can be carried out sequentially.

FIGS. 5A-D shows an illustrative connection of the plated 130 dielectric feed 120 to a microstrip trace 185 on the circuit board 182 and to a center conductor 183 of the coaxial cable 180. A first solder connection 187 couples the microstrip feed 185 to the center conductor 183 and a second solder connection 189 couples the dielectric feed 130 to the microstrip trace 185 on the circuit board 182.

In another aspect of the invention, an antenna having a dielectric feed with a wedge configuration includes an integrated microstrip feed, for example, so that a connection to the feed requires a single solder connection. The single solder connection couples the coaxial cable conductor to the integrated microstrip of the dielectric feed. This single solder configuration reduces potential antenna failures by reducing the number of solder connections and eliminating the need to physically align the dielectric feed with the microstrip trace, which also improves antenna performance.

Figure 6A:
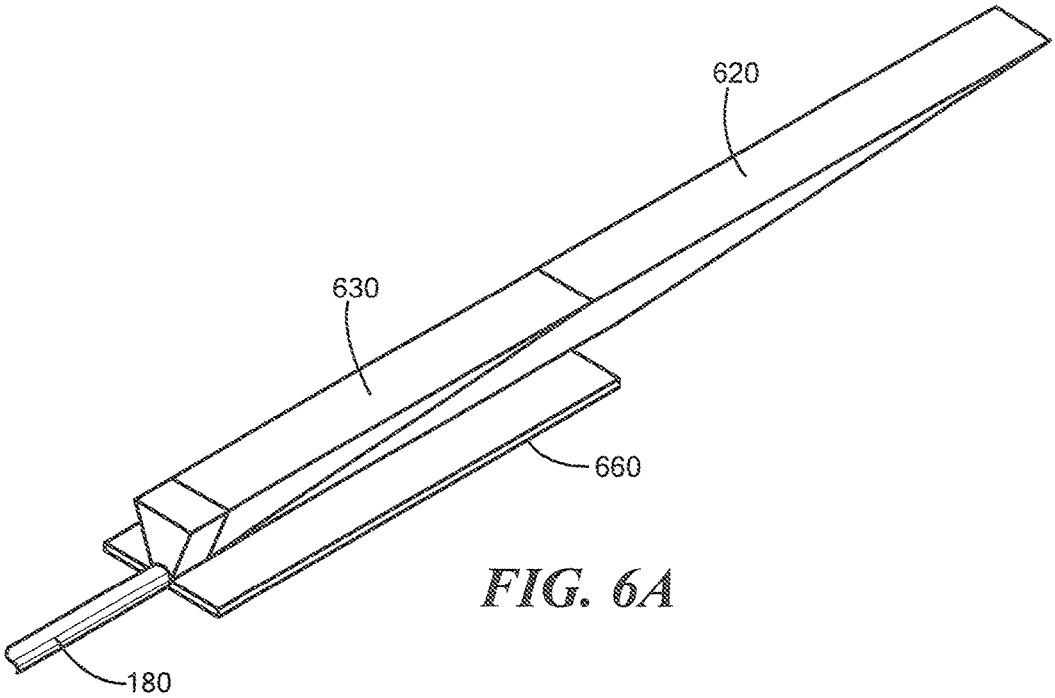
FIGS. 6A,B are schematic representations of an alternative illustrative antenna connection configuration having a single connection to the antenna.
Figure 6B:
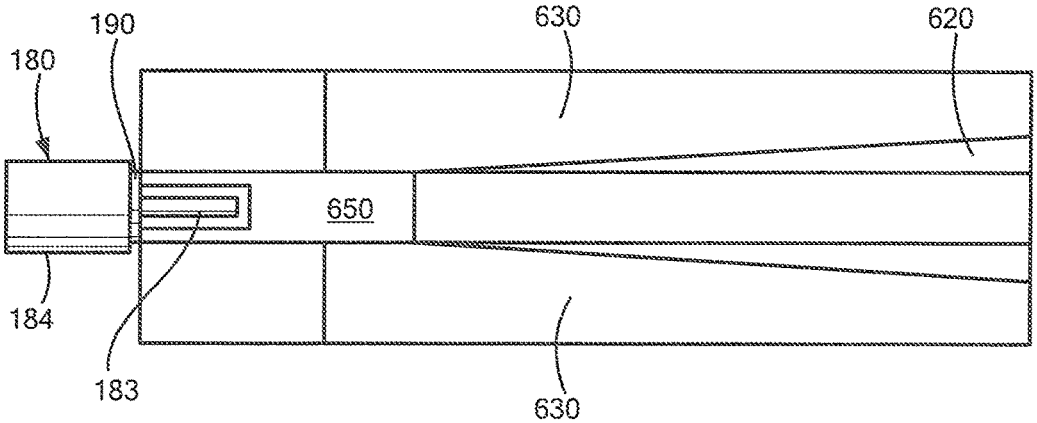

FIGS. 6A and 6B show an illustrative single point connection between a dielectric feed 620 and a coaxial cable 180, for example. As described above, conductive plating 630 covers a portion of the dielectric feed 620. The coaxial cable 180 includes a center conductor 183 and an outer conductor layer 184 separated by insulative material 190. The outer layer 184 of the coaxial cable is formed from a conductive material. The dielectric feed 620 includes an integrated microstrip trace 650 which forms part of a board 660.

Figure 7A:
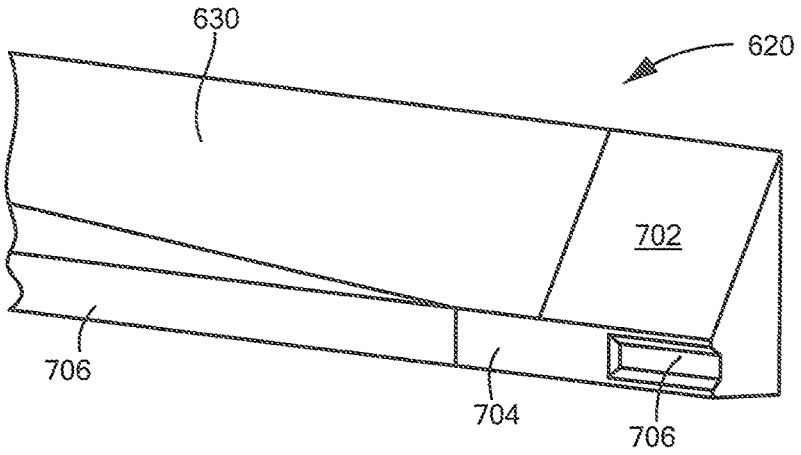
FIGS. 7A-C shows further detail of the antenna and antenna connections of FIGS. 6A-B.
Figure 7B:
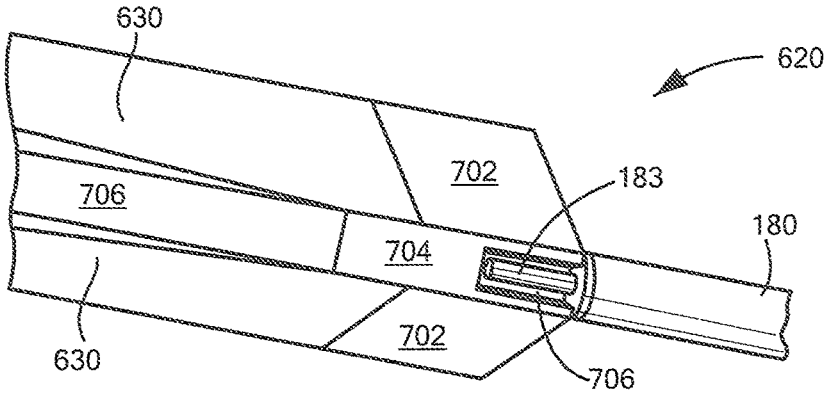
Figure 7C:
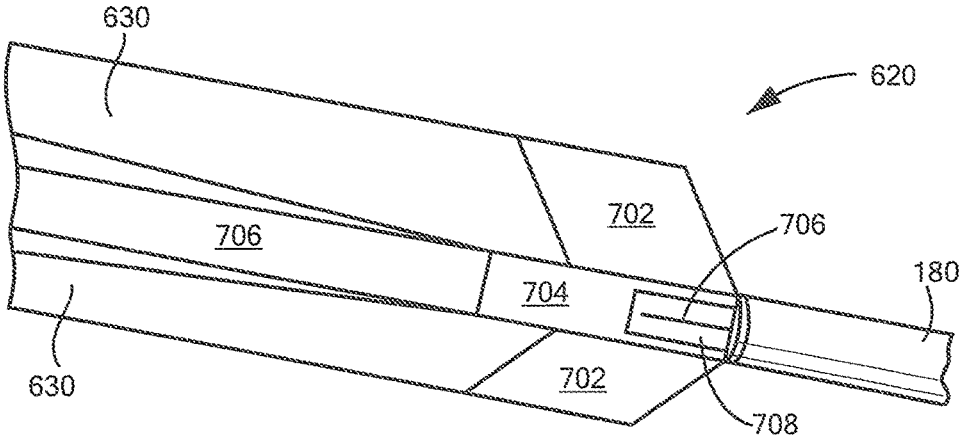

FIGS. 7A-C show further detail of the dielectric feed 620 and connector of FIGS. 6A-B. FIG. 7A shows a dielectric feed 620 (wedge), without a cable attached. In contrast to the feed of FIG. 5A, a portion of dielectric material 702 extends beyond the conductive plating 630 of the feed. A conductor 704 is placed on the bottom 706 of the wedge so as to integrate a microstrip trace with the dielectric feed 620 to provide a single solder connection to the antenna. In embodiments, the microstrip trace 704 includes a plated groove 706 to receive a conductor.

FIG. 7B shows a center conductor 183 of a coaxial cable 180 inserted, but not soldered, into the groove 706 of the microstrip trace of the dielectric feed 620. It will be readily appreciated that this configuration eliminates the need for the alignment required in multiple solder connection configurations, such as shown in FIGS. 5A-D.

FIG. 7C shows the center conductor 183 soldered 708 in the plated groove 706. With this arrangement, the coaxial cable 180 to microstrip trace 706 connection is the only soldered connection since the microstrip trace is integrated with the dielectric feed.

Figure 8:
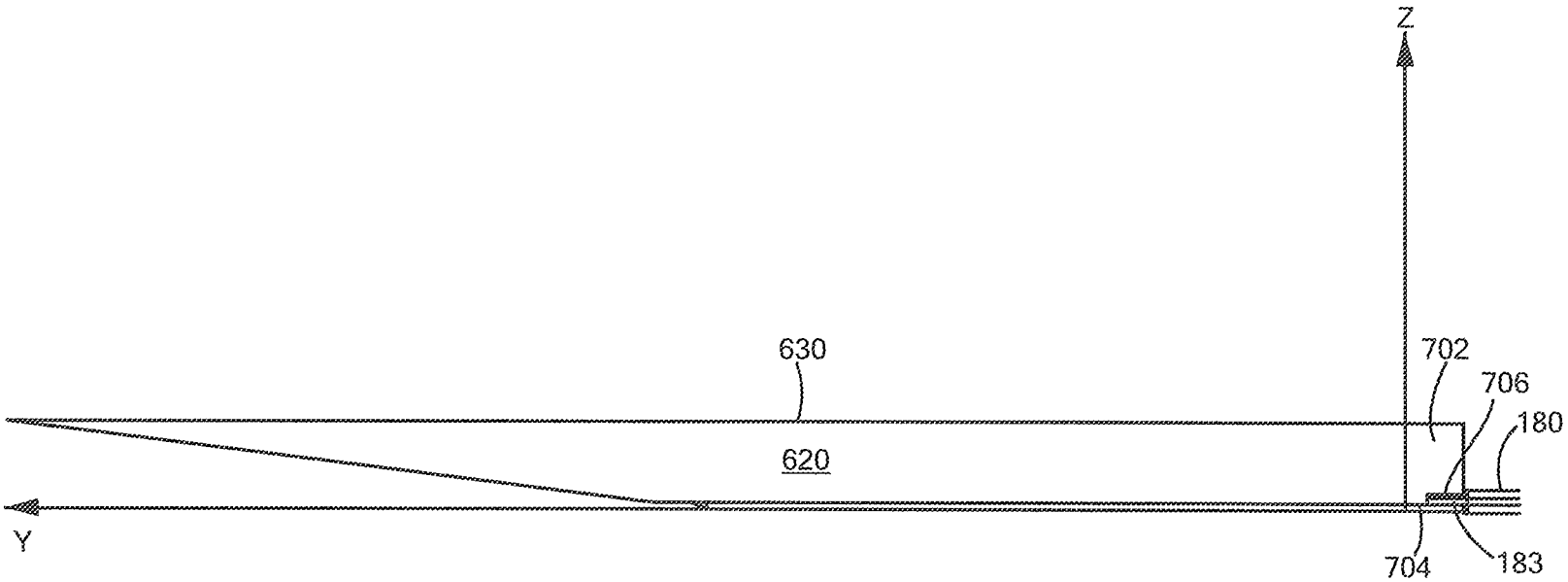
FIGS. 8 and 8A show cross-sectional views with further detail of the antenna and antenna connections of FIGS. 7A-C.
Figure 8A:
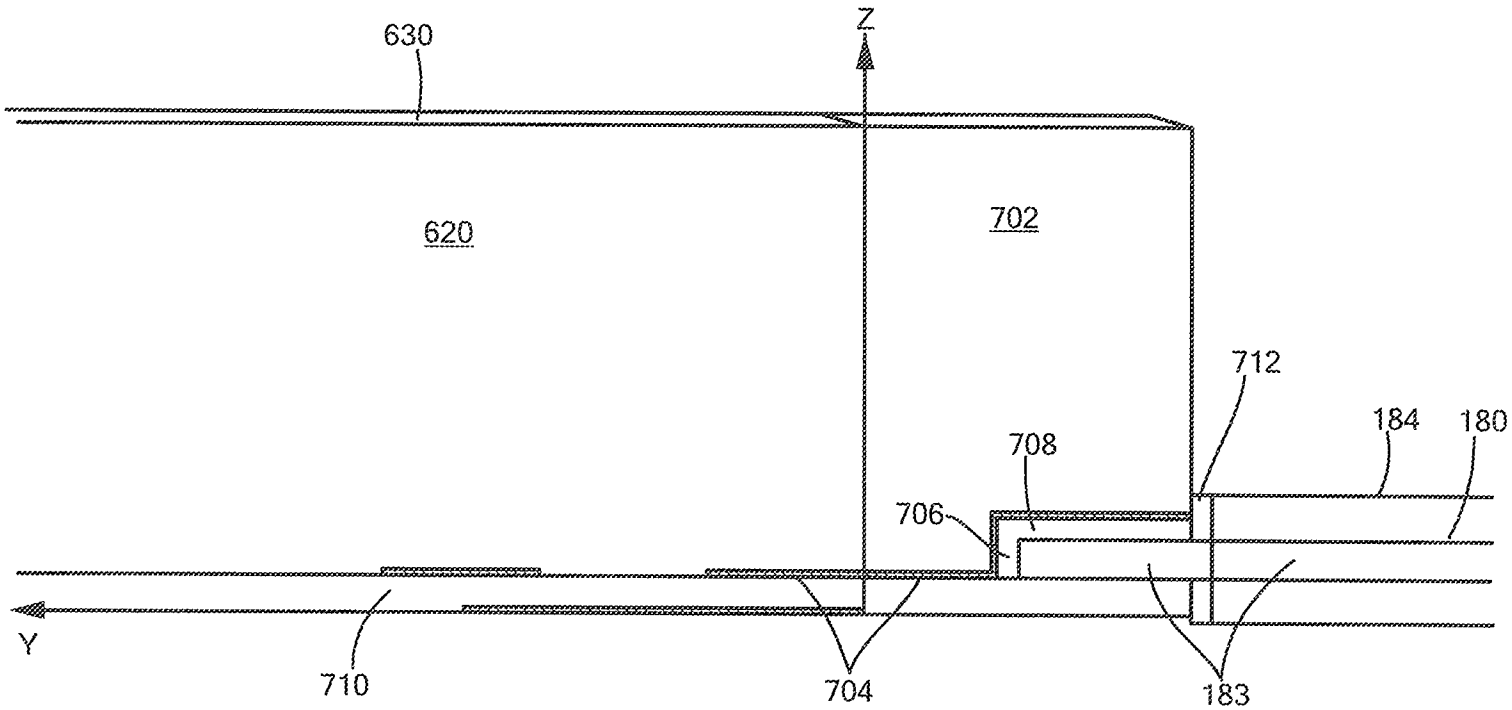

FIGS. 8 and 8A show a cross section of the tapered dielectric feed 620 having conductive plating 630, as described above. A coaxial cable 180 has a center conductor 183 soldered 708 in the plated groove 706 in the microstrip trace. A dielectric 712, such as PTFE (polytetrafluoroethylene), can be placed between the coaxial cable 180 and the dielectric feed 620.

The conductive plating portion 704 can be supported on a dielectric support board 710 which may not have conductive material. The conductive plating portion 704 on the bottom of the wedge extends into the groove 706 for integrating the microstrip trace into the dielectric feed 620. The dielectric material 702 extends beyond the conductive plating 630 of the feed to extend the wedge onto which the conductive plating portion 704 and groove 706 is placed.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. An antenna, comprising:

a ground plane having a recess with a tapered region accessible by an electromagnetic field via a radiating aperture at a forward end of the recess;

an elongate dielectric feed disposed in the recess, the dielectric feed having a tapered portion proximate the tapered region to guide the electromagnetic field into the recess through the radiating aperture and influence pattern directivity;

a conductive plating disposed at least partially about the dielectric feed in a wedge configuration to influence pattern beam width, and having a taper to facilitate propagation of the electromagnetic field over a range of frequencies, wherein the conductive plating is disposed toward a rearward end of the recess relative to the radiating aperture; and a conductive plating portion on a bottom of the wedge configuration coupled to the conductive plating and extending to a grooved trace to receive a conductor.

2. The antenna according to claim 1, wherein the grooved trace is configured to receive the center conductor of a coaxial cable.

3. The antenna according to claim 2, wherein the grooved trace is soldered to the conductor.

4. The antenna according to claim 3, wherein the soldered connection of the grooved trace and the conductor is the only solder connection to antenna.

5. The antenna according to claim 1, wherein the conductive plating on the dielectric feed does not overlap with the grooved trace.

6. The antenna according to claim 1, wherein the wedge configuration comprises a wedge angle of between about 45 degrees and about 60 degrees.

7. The antenna according to claim 1, wherein the recess comprises a depth of between about 2.5 mm and about 25 mm.

8. The antenna according to claim 1, wherein the taper of the conductive plating comprises a taper angle of between about 9 degrees and about 10 degrees.

9. The antenna according to claim 1, wherein a length of the dielectric feed in the radiating aperture is between about 13 mm and about 102 mm.

10. The antenna according to claim 1, further comprising a conductive cover disposed over a portion of the recess and forming the radiating aperture.

11. The antenna according to claim 1, further comprising an electromagnetic field absorber disposed in the recess.

12. The antenna according to claim 11, wherein the absorber comprises a magnetic material disposed toward the rearward end of the recess relative to the elongate dielectric feed to minimize electromagnetic scattering off a back wall of the recess.

13. The antenna according to claim 12, wherein the absorber is tapered narrower toward the forward end to influence broadband termination.

14. The antenna according to claim 12, wherein the magnetic material comprises a lossy magnetic load material.

15. The antenna according to claim 11, wherein the absorber comprises a non-magnetic material disposed to a side of the elongate dielectric feed to minimize interference from electromagnetic scattering off a side wall of the recess while allowing forward or backward directed electromagnetic energy in the recess.

16. The antenna according to claim 15, wherein the absorber comprises a tapered portion disposed proximate the tapered region of the recess in the radiating aperture.

17. The antenna according to claim 15, wherein the absorber is disposed lateral of the conductive plating.

18. The antenna according to claim 15, wherein the non-magnetic material comprises a lossy foam material.

19. The antenna according to claim 15, wherein the absorber is spaced at a lateral distance from the dielectric feed to facilitate electromagnetic radiation therebetween.

20. A method, comprising:

employing a ground plane having a recess with a tapered region accessible by an electromagnetic field via a radiating aperture at a forward end of the recess;

employing an elongate dielectric feed disposed in the recess, the dielectric feed having a tapered portion proximate the tapered region to guide the electromagnetic field into the recess through the radiating aperture and influence pattern directivity;

employing a conductive plating disposed at least partially about the dielectric feed in a wedge configuration to influence pattern beam width, and having a taper to facilitate propagation of the electromagnetic field over a range of frequencies, wherein the conductive plating is disposed toward a rearward end of the recess relative to the radiating aperture; and employing a conductive plating portion on a bottom of the wedge configuration coupled to the conductive plating and extending to a grooved trace to receive a conductor of a cable.

* * * * *